US007165438B2

(12) United States Patent
Heinl

(10) Patent No.: US 7,165,438 B2
(45) Date of Patent: Jan. 23, 2007

(54) WEDGE DRIVING TOOL HAVING MUTUALLY ADJUSTABLE ELEMENTS FOR THE CUTTING AND/OR NON-CUTTING SHAPING OF A SHEET METAL WORKPIECE IN A PRESS

(75) Inventor: Ernst Heinl, Zolling (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 11/365,851

(22) Filed: Mar. 2, 2006

(65) Prior Publication Data

US 2006/0150706 A1 Jul. 13, 2006

Related U.S. Application Data

(63) Continuation of application No. PCT/EP2004/008701, filed on Aug. 4, 2004.

(30) Foreign Application Priority Data

Sep. 3, 2003 (DE) ..... 103 40 509

(51) Int. Cl.
*B21D 5/04* (2006.01)

(52) U.S. Cl. ..... 72/452.9; 72/313; 72/387

(58) Field of Classification Search ..... 72/452.8, 72/452.9, 313, 315, 387
See application file for complete search history.

(56) References Cited

U.S. PATENT DOCUMENTS 1,812,046 A 6/1931 Groehn
2,421,864 A 6/1947 Becker
5,718,144 A * 2/1998 Korodan ..... 72/452.9
6,164,115 A 12/2000 Higuchi et al.
6,519,995 B2 * 2/2003 Matsuoka ..... 72/452.9
6,539,766 B2 * 4/2003 Matsuoka ..... 72/452.9
6,755,070 B2 * 6/2004 Jung ..... 72/452.9

FOREIGN PATENT DOCUMENTS

EP 0 272 175 A1 6/1988
EP 0 922 509 A1 6/1999
JP 62-296915 A 12/1987

OTHER PUBLICATIONS

International Search Report dated Nov. 30, 2004 (four (4) pages including English translation of pertinent portion).
German Search Report dated Nov. 10, 2003 (four (4) pages including English translation of pertinent portion).

* cited by examiner

*Primary Examiner*—David Jones
(74) *Attorney, Agent, or Firm*—Crowell & Moring LLP

(57) ABSTRACT

A wedge driving tool for cutting and/or non-cutting shaping of a sheet metal workpiece in a press includes a mould- and/or tool-bearing working slider, which may be displaced between a slider bed and a driver at a predetermined angle. For obtaining a working slider which may be continuously angularly adjusted, segmental disks are in each case arranged on both sides of the working slider in a continuously movable manner with respect to an angle of rotation, in each case, on the slider bed and the driver or on the working slider and the driver. The segmental disks, in each case, being arranged in pairs on an axis of rotation, are non-rotatably mutually connected along their chord-type boundaries such that corresponding straight-line guides, particularly for the working slider, are arranged in these connections.

20 Claims, 7 Drawing Sheets

50°
18
3'
2'
4
9'
"c"
"e"
11
8'
"d"
10
19
5
16
6'
7
"f"
1'

WEDGE DRIVING TOOL HAVING MUTUALLY ADJUSTABLE ELEMENTS FOR THE CUTTING AND/OR NON-CUTTING SHAPING OF A SHEET METAL WORKPIECE IN A PRESS

CROSS-REFERENCE TO RELATED APPLICATIONS

This application is a continuation of PCT Application No. PCT/EP2004/008701 filed on Aug. 4, 2004, which claims priority to German Application 103 40 509.7 filed Sep. 3, 2003.

BACKGROUND AND SUMMARY OF THE INVENTION

The invention relates to a wedge driving tool having mutually adjustable elements, particularly for the cutting and/or non-cutting shaping of a sheet metal workpiece in a press. The tool has, as elements, a mould- and/or tool-bearing working slider, which is displaceably arranged between a driving device controlled on the press side and a driver, and which is continuously angularly adjustable relative to the driver by way of a swivellably arranged driver-side straight-line guide.

Such a wedge driving tool, also called wedge slider or angle punch, is shown and described in U.S. Pat. No. 1,812,046. In this case, a working slider equipped with a punch is arranged as an oblong guide piston in a bush-type straight-line guide designed as a driver. This straight-line guide is continuously adjustable corresponding to the respective requirements over a relatively small acute angle range. The reason for the small adjusting angle range is the driving device, which is controlled on the press side and has a slide acted upon by the press slide and the slide, itself, acting upon toggle levers for operating the working slider equipped with the punch. Of these toggle levers, one is supported against the closed end of the bush-type straight-line guide for the stretched displacement of the other toggle lever and thus of the working slider. The kinematics of the driving device require high expenditures with respect to wear and friction and stress the mechanism of the angular adjusting device.

Another angle punch tool having an angularly adjustable straight-line guide for a working slider equipped with a punch is illustrated and described in U.S. Pat. No. 2,421,864, in which case the angular adjustability is achieved by way of a driver arranged swivellably with respect to a base plate of the angle punch tool. For this purpose, the driver and the base plate are constructed with corresponding circular-arc sections, for the locking of the respective acute angle, the two being provided with engaging serrations. A slider bed controlled by the press slide is the driving device displacingly acting upon the working slider. The disadvantage of this angle punch tool is that it lacks continuous angular adjustment as a result of the serrations.

Furthermore, a modern wedge driving tool is, for example, the object of U.S. Pat. No. 6,164,115. In the case of such wedge driving tools with the elements of a driver, a working slider and a slider bed, a working angle range of from 0° to approximately 60° is customary between a horizontal base of the driver and the corresponding straight-line guides of the driver and the working slider situated on top. And, between a horizontal connection surface of the slider bed on the press slide side and the corresponding straight-line guides of the slider bed and the driven working slider, a driving angle range of from approximately 50° to 0° is customary. In the case of industrially manufactured wedge driving tools, acute angles are offered in the above-mentioned angle ranges of only from 5° to 5°, which has the disadvantageous effect that the design engineer has to adapt the construction to these rigidly defined angles. If an adaptation is not possible, a new wedge driving tool with correspondingly set angles is required.

The advantages are therefore, on the one hand, the constructive constraints and, on the other hand, the considerable expenditures.

It is an aspect of the invention to construct a wedge driving tool such that, within the range of a largest possible acute angle, any desired working direction may be assigned to the working slider as a result of a continuous angular adjustment.

This aspect is made possible by providing another element as a slider bed having a driving effect on the working slider. In this case, on two of the elements respectively—the driver and the slider bed, or the driver and the working slider—segmental disks are in each case arranged on both sides in a continuously movable manner with respect to the angle of rotation. The segmental disks of each element each arranged in pairs on an axis of rotation are non-rotatably mutually connected along the chord-type boundaries such that corresponding straight-line guides for a respective element are arranged in these connections.

By way of the invention, a continuous angular adjustment is advantageously made possible on a modern wedge driving tool while the construction is kept simple.

Another advantage of the invention is an enlarged working angle range of up to approximately 85°. This angle range is advantageously divided into two areas of different sizes. For this purpose, in a first embodiment of the invention, a slider bed as well as the driver are each equipped with a pair of segmental disks which may be continuously moved with respect to the angle of rotation, for the continuous angular adjustment of a working slider with a driver-side working angle range of from 0° to 55°, and a driving angle range which can be correspondingly adapted on the slider bed side. In this case, the working slider may be displaced in a manner controlled by the press by way of corresponding straight-line guides relative to the segmental disk pairs.

In a second embodiment of the invention with respect to the larger angle range, the working slider, as well as the driver, are each equipped with a pair of continuously rotationally movable segmental disks for the continuous angular adjustment of a working slider with a driver-side working angle range of from 50° to approximately 85°, and a driving angle range which may be correspondingly adapted on the slider bed side. In this case, by way of the pair of segmental disks arranged in the working slider, the working slider is arranged to be displaceable at a predefined working angle by way of a straight-line guide oriented transversely with respect to the lifting direction of a press slide at the slider bed and the straight-line guide in the driver-side pair of segmental disks.

In order to achieve sufficiently long straight-line guides as well as a stable setup of the angular adjustments according to the invention, the segmental disks, having a relatively large diameter and, in each case, along their outer circumference having a predetermined axial thickness, are arranged in a movable manner with respect to the angle of rotation in a guide constructed in a circular-arc-shape in the respective element, that is the driver, slider bed, and/or working slider.

The wedge driving tool according to the invention offers several possibilities with respect to a fixing of the angle. In one case, the segmental disks of at least one element are detachably fixed on the element while the working angle is defined for a predetermined working direction. This makes it possible for a customer of an industrially manufactured wedge driving tool according to the invention to use the latter also for other angular adjustments, with, in each case, a separately adapted releasable fixation. If, in contrast, in the case of a wedge driving tool, the once defined working angle is to remain unchanged, the implemented angular adjustment may be secured by way of a non-detachable fixing. The series production of the wedge driving tool according to the invention is advantageously simplified by using segmental disks which eliminates different angle adjusting devices.

Finally, by way of the wedge driving tool according to the invention, a universal angle fixation is achieved in that the segmental disks of the elements are to be releasably fixed in any continuous angular adjustment by a force-locking/frictionally engaged blocking device. By way of example only, clamping devices, a self-locking gear, a locking screw interacting with a curved oblong hole on the segmental disk, or a spiral toothing arranged on a segmental disk in cooperation with a counterpart arranged on the respective element so that it may be displaced in a curved manner and clamped, are possible as blocking devices.

Other objects, advantages and novel features of the present invention will become apparent from the following detailed description of the invention when considered in conjunction with the accompanying drawings.

DETAILED DESCRIPTION OF THE DRAWINGS

Figure 1:
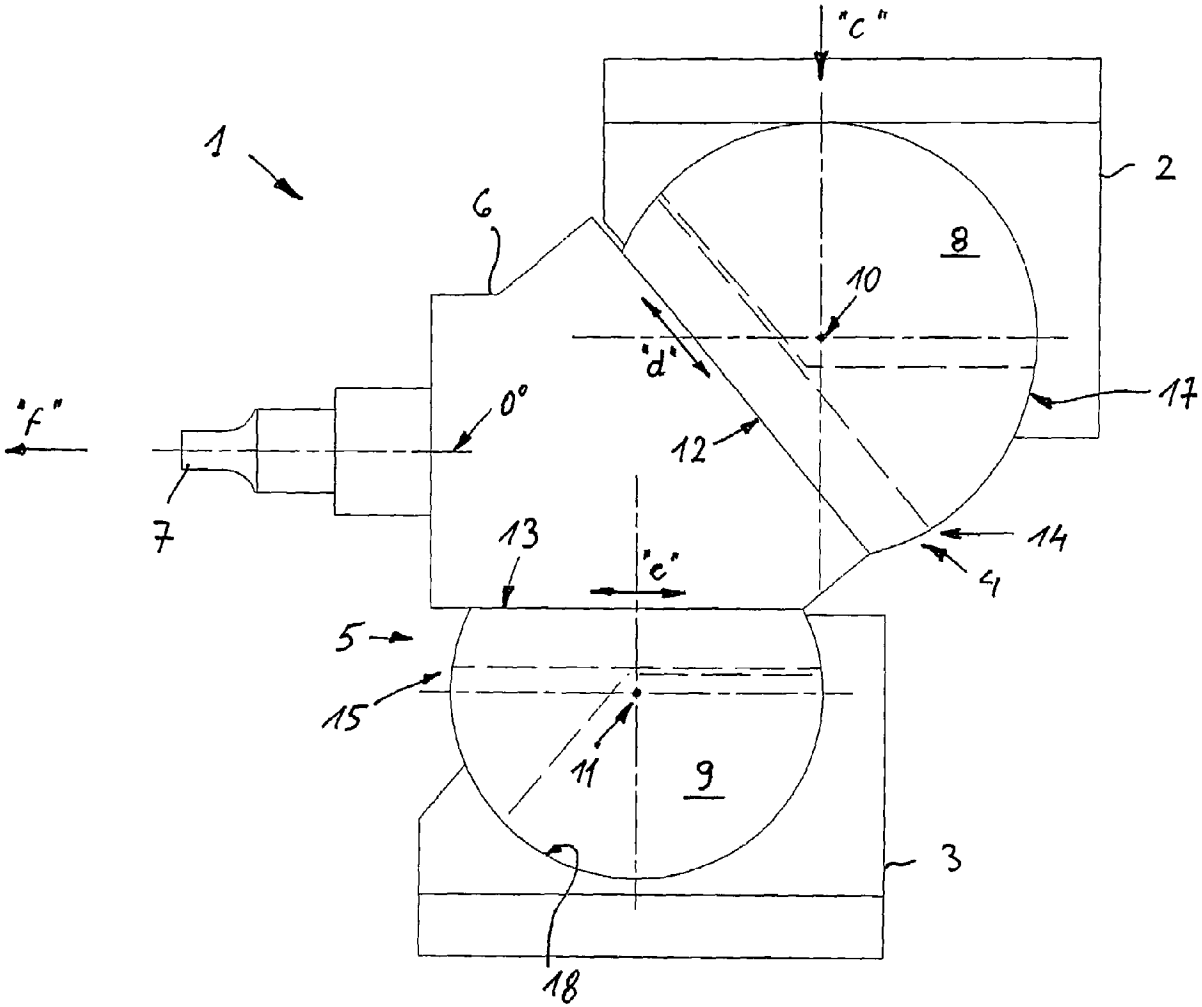
FIG. 1 is a schematic view of a wedge driving tool according to one embodiment of the invention for a working angle range of 0° to 55° with a horizontally directed working angle.
Figure 2:
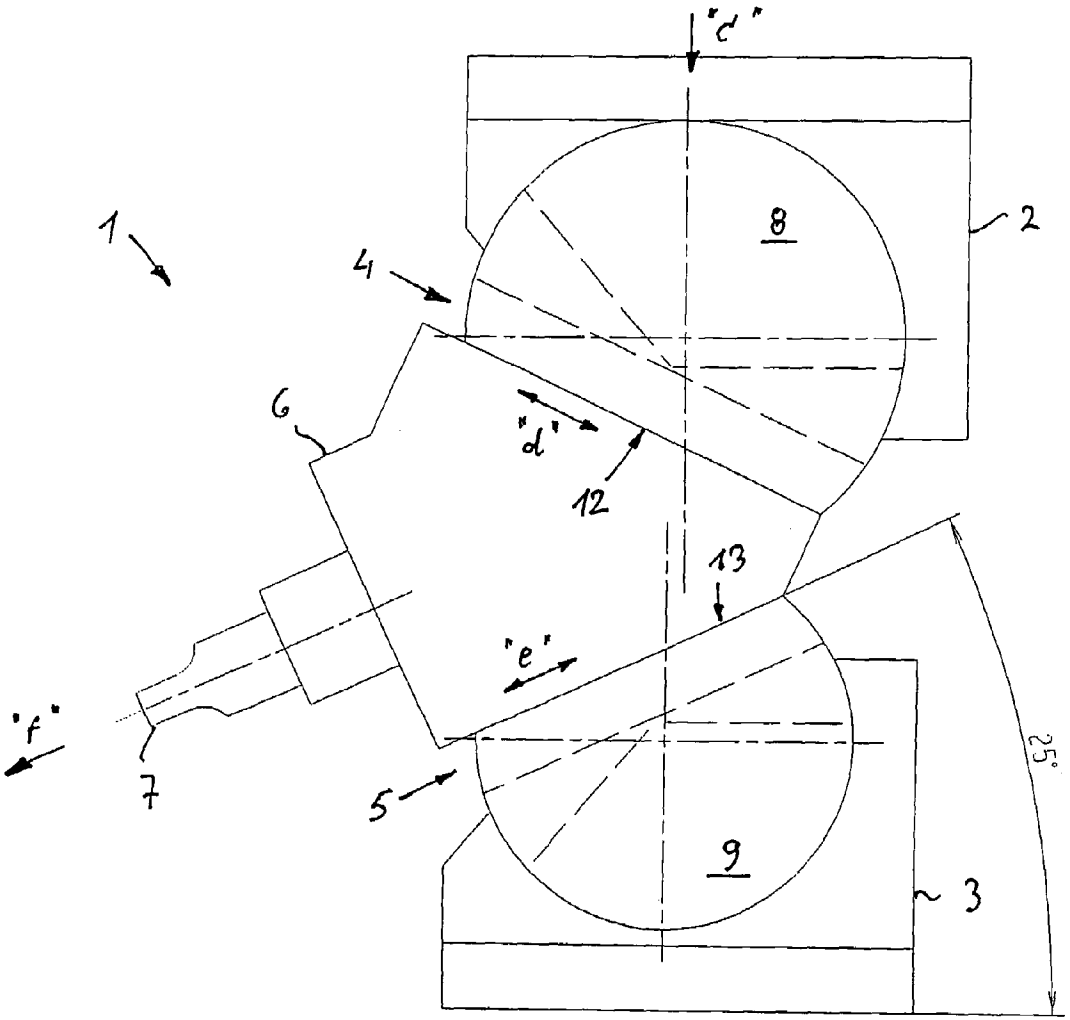
FIG. 2 is a schematic view of the above-mentioned wedge driving tool with a working angle of 25°.
Figure 3:
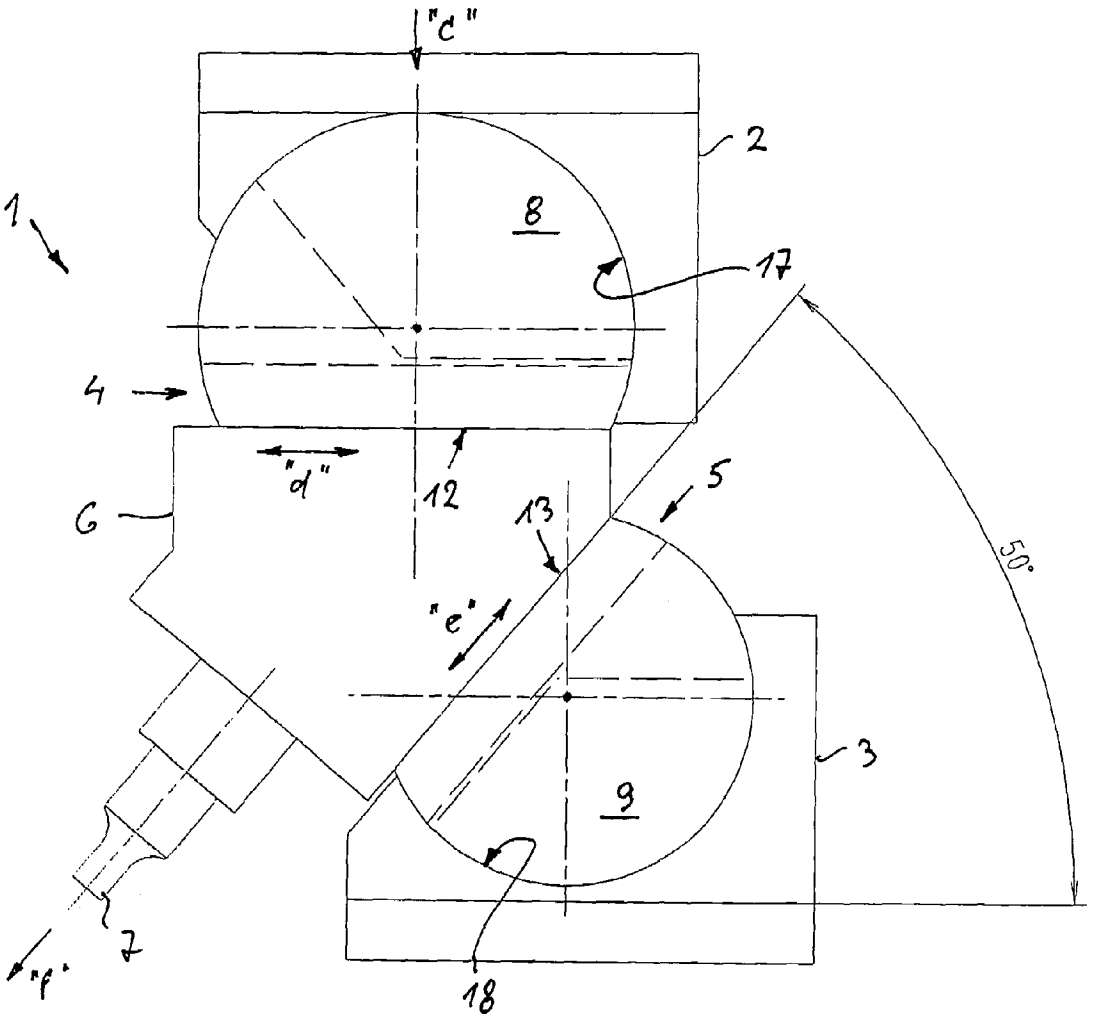
FIG. 3 is a schematic view of the wedge driving tool with a working angle of 50°.

In a known manner, a wedge driving tool 1 is illustrated in FIGS. 1–3 for the non-cutting forming of a sheet metal workpiece in a press (the workpiece and press not being shown). The wedge driving tool includes as elements, in a known manner, a slider bed 2 fixedly connected with a press slide as well as a driver 3 fixedly arranged on a press table, and a working slider 6 which is provided in-between in a slidable manner by way of corresponding straight-line guides 4, 5 arranged in a mutually acute-angled manner. The working slider 6 is equipped, for example, with a punch 7 for punching a sheet metal workpiece, which punch points in the displacing direction.

In order to construct the working slider 6 according to the invention in a continuously angularly adjustable manner, on two of the elements respectively, that is the slider bed 2 and the driver 3, segmental disks 8 and 9 are, in each case, arranged on both sides in a continuously movable manner with respect to the angle of rotation. In this case, the segmental disks 8, 9 of each element 2, 3 each arranged in pairs on an axis of rotation are non-rotatably mutually connected along the chord-type boundaries 12, 13 such that corresponding straight-line guides 4, 5 for the respective element 2, 3, 6 are arranged in these connections 14, 15.

By way of the invention, on the whole, an acute angle of from 0° to approximately 85° with respect to working angles for the working slider 6 becomes possible, however, not by means of a single segmental disk arrangement.

The above-mentioned working angle range is, therefore, divided into two partial ranges of different sizes, for the continuous angular adjustment of a working slider 6 with a driver-side working angle range of from 0° to approximately 55° and a driving angle range which can be correspondingly adapted on the slider bed side. The slider bed 2 controlled on the press side, as well as the driver each is equipped with a pair of segmental disks 8 and 9 which can be continuously moved with respect to an angle of rotation. The working slider 6 is displaceable in a press-controlled manner by way of corresponding straight-line guides 4, 5 relative to the segmental disk pairs 8; 9 according to the arrows "d" and "e" for achieving a movement of the working slider 6 in the working direction according to arrow "f".

In FIG. 1, the working direction of the working slider 6 of the wedge driving tool 1, which, for a better illustration of the invention, is shown only in basic diagram, is oriented horizontally or parallel to the platen (which is not shown) and carries the driver 3, the 0° working angle being assigned to this orientation. In FIG. 2, the working slider 6 is oriented at an acute working angle of 25° to the horizontal line or to the horizontal platen of the press, while an acute working angle of 50° is selected for the working slider 6 in FIG. 3. According to the invention, any working angle between 0° and approximately 55° can be continuously selected for the working slider 6.

Figure 4:
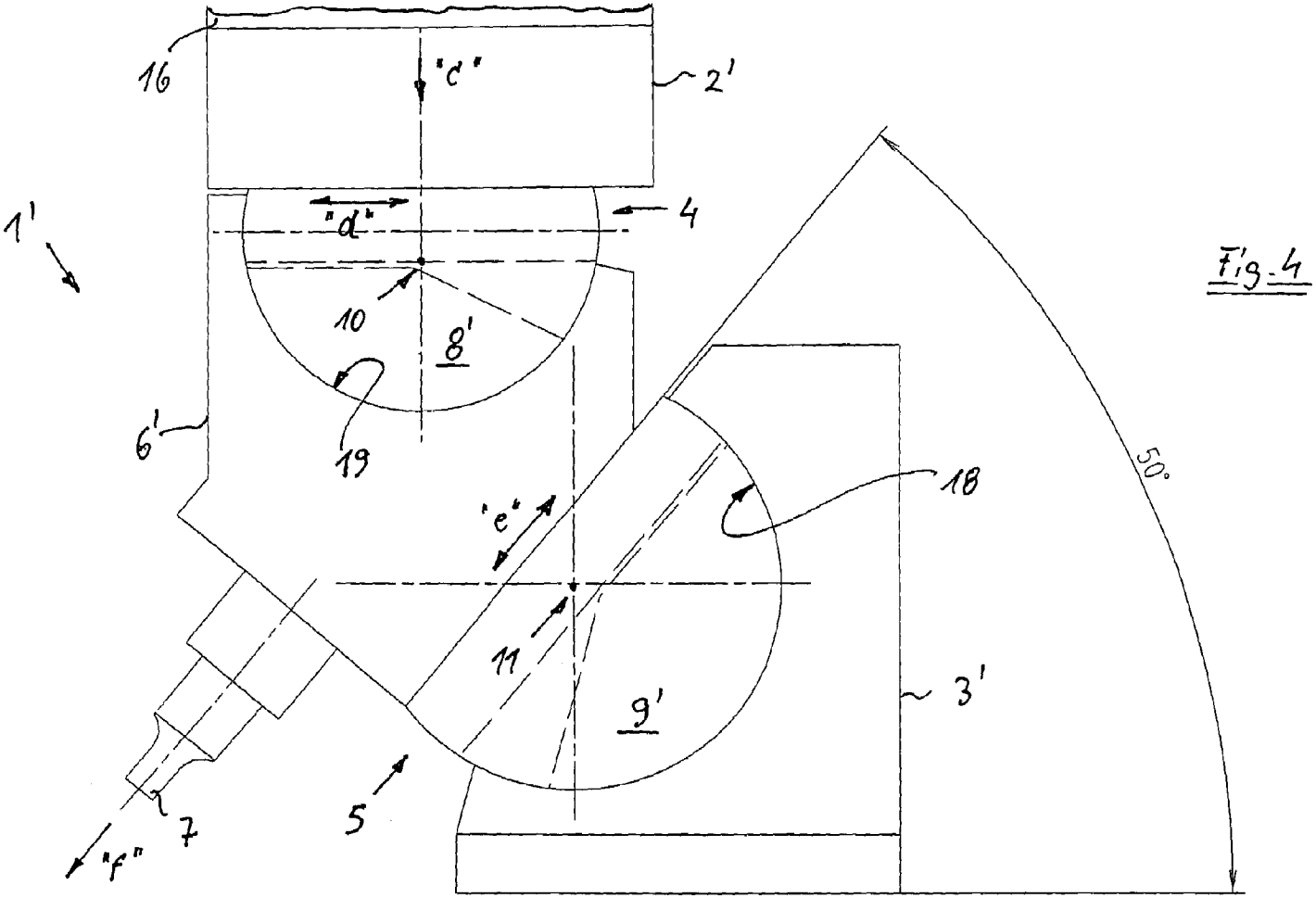
FIG. 4 is a schematic view of another embodiment of a wedge driving tool for a working angle range of from 50° to approximately 85° with a selected working angle of 50°.
Figure 5:
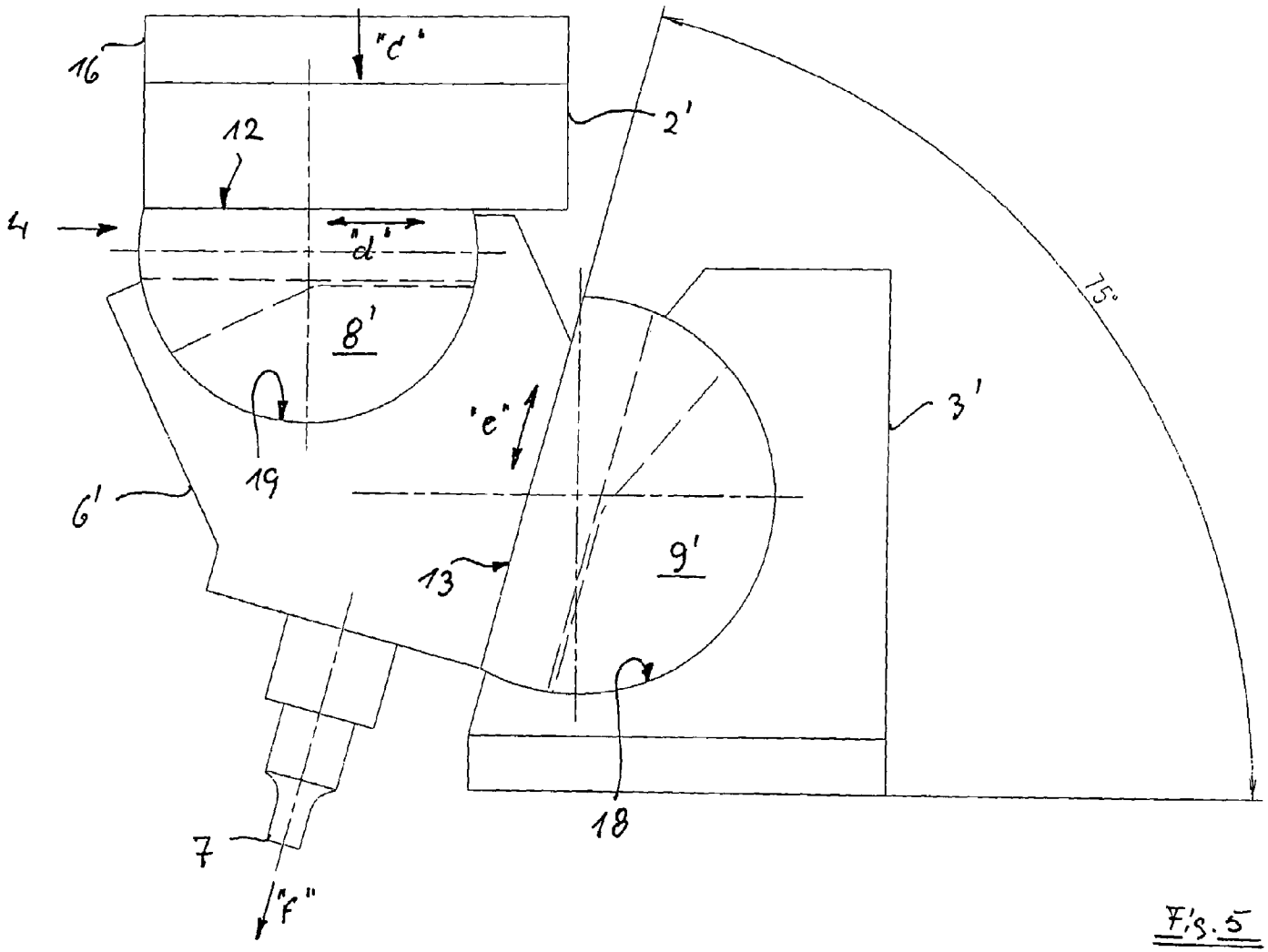
FIG. 5 is a schematic view of the wedge driving tool of FIG. 4 with an adjusted working angle of 75°.

For achieving an acute working angle which exceeds the above, according to FIGS. 4 and 5, the working slider 6' as well as the driver 3' are each equipped with a pair of continuously rotationally movable segmental disks 8, 8' and 9, 9', for the continuous angular adjustment of the working slider 6' of a wedge driving tool 1' with a driver-side working angle range of from 50° to approximately 85° and a driving angle range which can be correspondingly adapted on the slider bed side. In contrast to the wedge driving tool 1 of FIGS. 1 to 3, for achieving the greater working angle range, the segmental disk pair 8, 8' is rotationally movably arrange not in the slider bed 2 but in the working slider 6'. In this case, by way of the segmental disk pair 8' arranged in the working slider 6', the working slider 6' is displaceably arranged by way of straight-line guide 4 oriented transversely to the lifting direction according to arrow "c" of a press slide 16 on the slider bed 2', and by way of the straight-line guide 5 in the drive-side segmental disk pair 9'.

Furthermore, a stable construction of the angular adjusting device is achieved in that the segmental disks 8, 8'; 9, 9' of a relatively large diameter are in each case angularly movably disposed by way of their outer circumference having a predetermined axial thickness, in a guide 17, 18, 19 constructed in a circular-arc shape in the respective element 2, 3; 3', 6'.

For series-produced wedge driving tools 1 and 1', the segmental disks 8, 8'; 9, 9' of at least one element 2, 3; 3', 6', in the case of a working angle defined for a single predetermined working direction, may be detachably or non-detachably fixed to the respective element 2, 3; 3', 6'.

In contrast, for series-produced wedge driving tools 1 and 1' with a frequent change of the driver-side working angle, it is suggested that the segmental disks 8, 8'; 9, 9' of the elements 2,3; 3'6' be detachably fixable in any continuous angular adjustment by way of a force-locking/frictionally engaged and/or form-lockingly effective blocking device (not shown).

Figure 6:
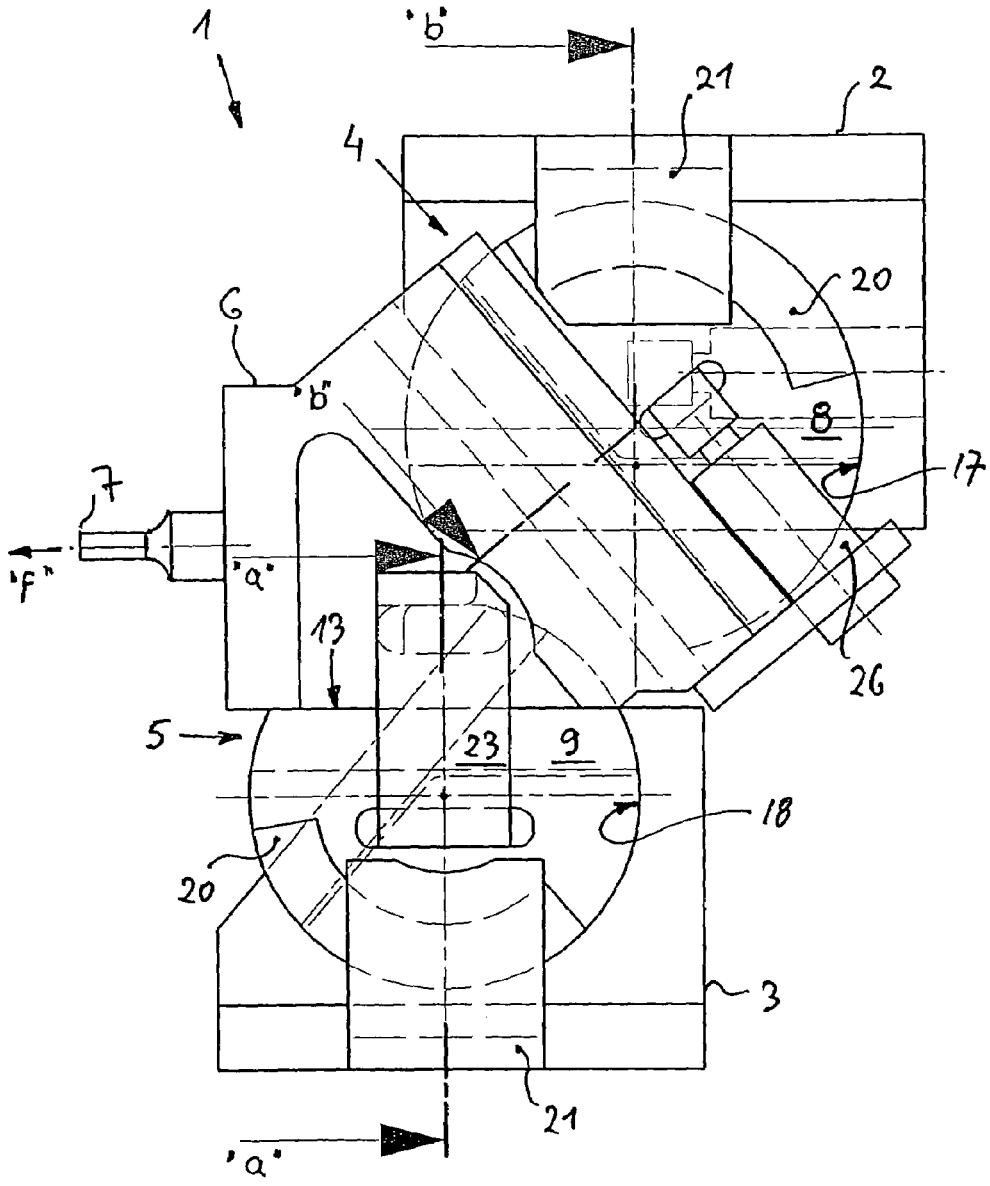
FIG. 6 is a view of a wedge driving tool illustrated in a basic construction in FIGS. 1–3 in a practical embodiment.
Figure 7:
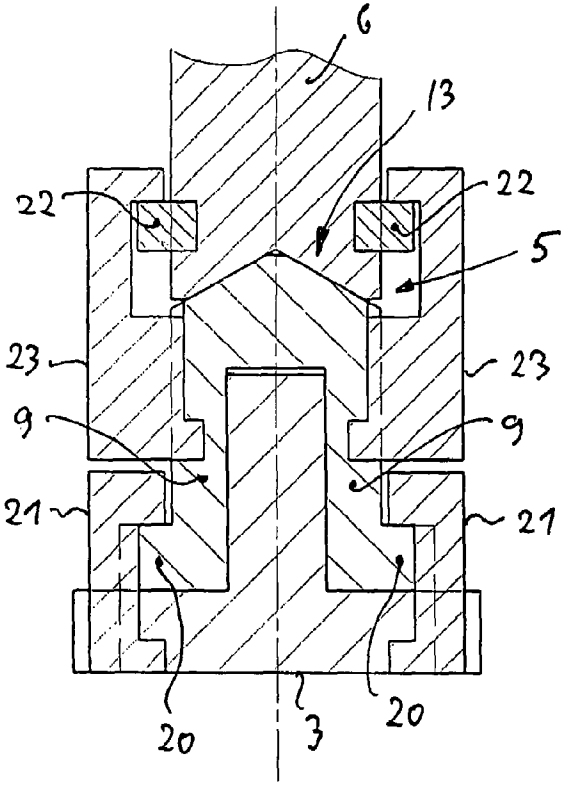

The wedge driving tool 1 shown in a practical construction in FIG. 6 corresponds to the wedge driving tool 1 illustrated in the basic diagrams of FIGS. 1 to 3, and its identical components have the same reference numbers. Instead of shafts non-rotatably connecting the segmental disks 8 and 9 of the elements 2 and 3, or separate axles, which cannot be arranged for constructional reasons, each of the above-mentioned segmental disks 8, 9 has an additional integrated curved guide 20, which is in each case in a slidably movable connection with a clamp 21 fixed to the slider 2 or to the driver 3, as illustrated in detail in FIG. 7. For the secure holding of the working slider 6 on the driver-side straight-line guide 5 of the mutually connected segmental disks 9, the working slider 6 is equipped with straight-line guide rails 22 which are in a displaceably movable connection with clamps 23 form-lockingly anchored in the segmental disks 9. In order to avoid lateral loads on these clamps 23, the corresponding straight-line guides 5 of the working slider 6 and the segmental disks 9 have cross-sections with a V-shaped profile.

Figure 8:
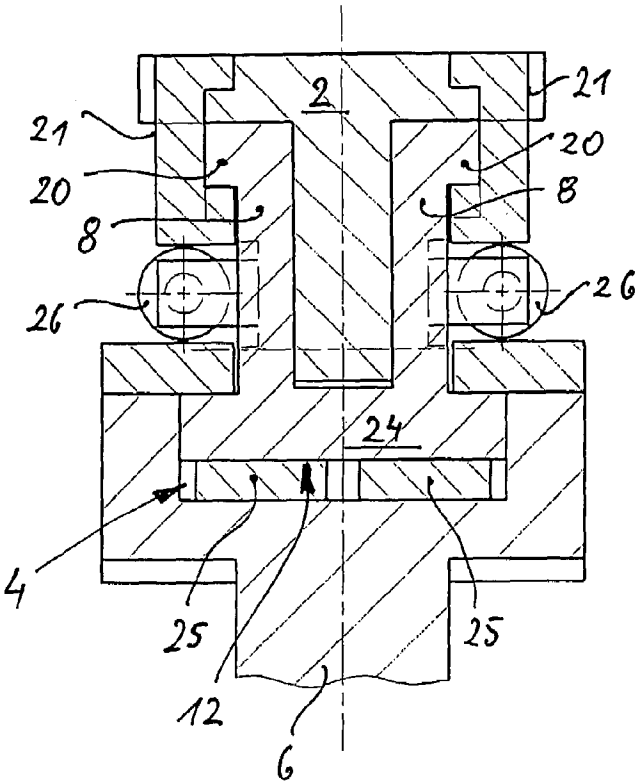
FIGS. 7, 8 are sectional views, respectively, according to "a—a" and "b—b" of the wedge driving tool of FIG. 6.

Finally, FIG. 8 shows an alternative embodiment of the corresponding straight-line guides 4 between the segmental disks 8 of the slider bed 2 and the working slider 6. In this case, the segmental disks 8 are supported by way of a joint connection piece 24 with the insertion of sliding rails 25 against the working slider 6. A device which restores the working slider 6 after a shaping operation relative to the slider bed 2 has the reference number 26.

By way of the invention, an advantageously continuous adjustment of a desired working angle is achieved for a working slider fastened at the top as well as at the bottom, which results in a reduction of the number of standardized wedge sliders to essentially the two above-described embodiments for working angles up to approximately 55° and 85°.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A wedge driving tool having mutually adjustable elements for shaping of a sheet metal workpiece in a press, the tool comprising:

a slider bed controlled on a press side of the wedge driving tool;

a driver operatively configured for the wedge driving tool;

a driver-side straight-line guide that is pivotably arranged;

a slider bed-side straight-line guide that is pivotably arranged;

a working slider, which is displaceably arranged between the slider bed and the driver, the working slider being continuously angularly adjustable relative to the driver by way of the driver-side straight-line guide; and segmental disks, which are continuously movable with respect to an angle of rotation, arranged on both sides of two of the driver, the slider bed and the working slider;

wherein the slider bed is configured to act in a driving manner upon the working slider; and wherein the segmental disks are arranged in pairs on an axis of rotation of each of the two of the driver, the slider bed and the working slider and are non-rotatably connected to each other along chord-type boundaries that form connections at the driver side straight-line guide and the slider bed-side straight-line guide.

2. The wedge driving tool according to claim 1, wherein, for continuous angular adjustment of the working slider with a driver-side working angle range of from 0° to approximately 55° , and a driving angle range which is correspondingly adapted on the slider bed-side the slider bed and the driver are each equipped with a pair of segmental disks which are continuously movable with respect to the angle of rotation; and wherein the working slider, by way of the driver side straight-line guide and the slider bed-side straight-line guide, is displaceable in a press-controlled manner relative to the segmental disk pairs.

3. The wedge driving tool according to claim 1, wherein, for continuous angular adjustment of the working slider with a driver-side working angle range of from 50° to approximately 85° and a driving angle range which is correspondingly adapted on the slider bed side, the working slider and the driver are each equipped with a pair of segmental disks which are continuously movable with respect to the angle of rotation; and wherein, by way of a pair of the segmental disks arranged in the working slider, the working slider is displace ably arranged by way of the slider bed-side straight-line guide which is transversely oriented with respect to a lifting direction of a press slide on the slider bed, and by way of the driver-side straight-line guide in the driver-side segmental disk pair.

4. The wedge driving tool according to claim 2, wherein the segmental disks, having a relatively large diameter and, in each case, over their outer circumference having a predetermined axial thickness, are disposed in a movable manner with respect to the angle of rotation in a guide constructed in a circular-arc-shape in the respective element.

5. The wedge driving tool according to claim 3, wherein the segmental disks, having a relatively large diameter and, in each case, over their outer circumference having a predetermined axial thickness, are disposed in a movable manner with respect to the angle of rotation in a guide constructed in a circular-arc-shape in the respective element.

6. The wedge driving tool according to claim 1, wherein the segmental disks of at least one of the two of the driver, the slider bed and the working slider, at a working angle defined for a single predetermined working direction, are detachably or non-detachably fixed to the at least one of the two of the driver, the slider bed and the working slider.

7. The wedge driving tool according to claim 2, wherein the segmental disks of at least one of the two of the driver, the slider bed and the working slider, at a working angle defined for a single predetermined working direction, are detachably or non-detachably fixed to the at least one of the two of the driver, the slider bed and the working slider.

8. The wedge driving tool according to claim 3, wherein the segmental disks of at least one of the two of the driver, the slider bed and the working slider, at a working angle defined for a single predetermined working direction, are detachably or non-detachably fixed to the at least one of the two of the driver, the slider bed and the working slider.

9. The wedge driving tool according to claim 1, wherein the segmental disks are to be detachably fixed by a force-locking/frictionally engaged and/or form-locking blocking device in any continuous angular adjustment.

10. The wedge driving tool according to claim 2, wherein the segmental disks are to be detachably fixed by a force-locking/frictionally engaged and/or form-locking blocking device in any continuous angular adjustment.

11. The wedge driving tool according to claim 3, wherein the segmental disks are to be detachably fixed by a force-locking/frictionally engaged and/or form-locking blocking device in any continuous angular adjustment.

12. The wedge driving tool according to claim 2, wherein the segmental disks each have an additional curved guide which interacts with one clamp respectively in a slidingly movable manner; and wherein, for holding the working slider at the segmental disks of the driver, the working slider is equipped with straight-line guide rails which are in a slidingly movable connection with clamps arranged on the segmental disks of the driver, the driver-side straight-line guide corresponds to the working slider and the driver-side segmental disks have a cross-section with a V-shaped profile.

13. The wedge driving tool according to claim 5, wherein the segmental disks each have an additional curved guide which interacts with one clamp respectively in a slidingly movable manner; and wherein, for holding the working slider at the segmental disks of the driver, the working slider is equipped with straight-line guide rails which are in a slidingly movable connection with clamps arranged on the segmental disks of the driver, the driver-side straight-line guide corresponds to the working slider and the driver-side segmental disks have a cross-section with a V-shaped profile.

14. The wedge driving tool according to claim 11, wherein the segmental disks each have an additional curved guide which interacts with one clamp respectively in a slidingly movable manner; and wherein, for holding the working slider at the segmental disks of the driver, the working slider is equipped with straight-line guide rails which are in a slidingly movable connection with clamps arranged on the segmental disks, the driver-side straight-line corresponds to the working slider and the driver-side segmental disks have a cross-section with a V-shaped profile.

15. The wedge driving tool according to claim 2, wherein the connection of the segmental disks of the slider bed is designed as a one-piece connection piece, which, with the insertion of flat sliding rails, supports the segmental disks against the working slider; and wherein the working slider is moved by a restoring device into a starting position relative to the segmental disks.

16. The wedge driving tool according to claim 3, wherein the connection of the segmental disks of the slider bed is designed as a one-piece connection piece, which, with the insertion of flat sliding rails, supports the segmental disks against the working slider; and wherein the working slider is moved by a restoring device into a starting position relative to the segmental disks.

17. The wedge driving tool according to claim 1, wherein the wedge driving tool is for one of non-cutting and cutting shaping of the sheet metal workpiece in the press.

18. A wedge driving tool for shaping of a sheet metal workpiece in a press, the wedge driving tool comprising:

a slider bed operatively configured to be fixedly coupled with a press slide;

a driver operatively configured to be fixedly arranged on a press table;

a working slider operatively arranged between the driver and the slider bed so as to be displaceably guided via respective straight-line guides, which straight-line guides are arranged in a mutually acute-angled manner with respect to one another;

a first segmental disk operatively arranged in one of the slider bed and the working slider, the first segmental disk being angularly rotatable;

a second segmental disk operatively arranged in the driver and being angularly rotatable;

wherein the first and second segmental disks are operatively coupled with the working slider, wherein the couplings of the segmental disks with the working slider form the straight-line guides.

19. The wedge driving tool according to claim 18, wherein a pair of the first segmental disks are arranged on one of the slider bed and the working slider, and a pair of the second segmental disks are arranged on the driver.

20. The wedge driving tool according to claim 19, wherein the first and second segmental disks each have an additional curved guide interacting with one clamp, respectively, in a slidingly movable manner; and wherein for holding the working slider at the second segmental disk pair of the driver, the working slider is equipped with straight-line guide rails that are in a slidingly movable coupling with clamps arranged on the second segmental disks; and further wherein the associated straight-line guide of the working slider and the driver-side second segmental disks have a V-shaped profile cross-section.

* * * * *